US010395597B2

(12) United States Patent
Yang et al.

(10) Patent No.: US 10,395,597 B2
(45) Date of Patent: Aug. 27, 2019

(54) METHOD AND DEVICE FOR ADJUSTING A GAMMA VOLTAGE OF A CURVED DISPLAY PANEL

(71) Applicants: BOE TECHNOLOGY GROUP CO., LTD., Beijing (CN); ORDOS YUANSHENG OPTOELECTRONICS CO., LTD., Inner Mongolia (CN)

(72) Inventors: Hualing Yang, Beijing (CN); Lina Liu, Beijing (CN)

(73) Assignees: BOE TECHNOLOGY GROUP CO., LTD., Beijing (CN); ORDOS YUANSHENG OPTOELECTRONICS CO., LTD., Ordos (CN)

( * ) Notice: Subject to any disclaimer, the term of this patent is extended or adjusted under 35 U.S.C. 154(b) by 0 days.

(21) Appl. No.: 15/864,461

(22) Filed: Jan. 8, 2018

(65) Prior Publication Data

US 2018/0336824 A1 Nov. 22, 2018

(30) Foreign Application Priority Data

May 17, 2017 (CN) ..... 2017 1 0347876

(51) Int. Cl.
*G09G 3/3258* (2016.01)

(52) U.S. Cl.
CPC ... *G09G 3/3258* (2013.01); *G09G 2310/0232* (2013.01); *G09G 2320/0276* (2013.01); *G09G 2320/0673* (2013.01); *G09G 2330/12* (2013.01); *G09G 2360/145* (2013.01)

(58) Field of Classification Search
CPC ..... G09G 3/3258; G09G 2320/0673; G09G 2320/0276; G09G 3/207; G09G 3/36; G09G 2300/0452; G09G 2360/16; G09G 2310/0232; G09G 2310/0242; G09G 2300/0443; G09G 3/20; G09G 3/3611; G09G 2330/12; G09G 2360/145
See application file for complete search history.

(56) References Cited

U.S. PATENT DOCUMENTS

2014/0098095 A1* 4/2014 Lee ..... G06F 3/041 345/420
2014/0306985 A1* 10/2014 Jeong ..... G09G 3/3233 345/601

(Continued)

*Primary Examiner* — Md Saiful A Siddiqui
(74) *Attorney, Agent, or Firm* — McDermott Will & Emery LLP

(57) ABSTRACT

A method for adjusting a gamma voltage of a curved display panel includes following steps. A first gamma voltage is used as a gamma voltage of a planar display region of a curved display panel in a situation that the planar display region of the curved display panel is horizontally placed and in a white balance state. A curved display region of the curved display panel is divided into a plurality of sub-regions according to a bending degree of the curved display region of the curved display panel. A plurality of inclined angles are determined. A plurality of second gamma voltages are determined in a one-to-one correspondence with the plurality of inclined angles in a situation that the planar display region of the curved display panel is tilted at the plurality of inclined angles and in the white balance state.

13 Claims, 4 Drawing Sheets

(56) References Cited

U.S. PATENT DOCUMENTS

2015/0248865 A1* 9/2015 Lim ..... G09G 3/3696
345/691
2016/0057318 A1* 2/2016 Hsieh ..... H04N 5/202
345/690

* cited by examiner

METHOD AND DEVICE FOR ADJUSTING A GAMMA VOLTAGE OF A CURVED DISPLAY PANEL

CROSS-REFERENCE TO RELATED APPLICATION

This application claims benefit and priority to Chinese Patent Application No. 201710347876.7, filed on May 17, 2017, titled "METHOD AND DEVICE FOR ADJUSTING A GAMMA VOLTAGE OF A CURVED DISPLAY PANEL", which is incorporated herein by reference in its entirety.

TECHNICAL FIELD

The present disclosure relates to the technical field of display, and more particularly, to a method and a device for adjusting a gamma voltage of a curved display panel.

BACKGROUND

With the continuous development of display technology, the development process of a flexible display panel is gradually accelerated. The flexible display panel will have a profound impact on the application of a wearable device due to its low power consumption, bendable and foldable features. In addition, the flexible display panel will be widely used in future with the continuous infiltration of the personal intelligent terminal.

An Active-matrix Organic Light-Emitting Diode (AMOLED) display panel is an important flexible display panel. This panel has excellent characteristics such as self-luminous, no requirement of backlight, wide color gamut, high contrast, thin thickness, wide viewing angle, fast response, being used for flexural panel, wide temperature range, and simple structure and process.

Generally, after the AMOLED display panel is prepared, the brightness of each of gray scales displayed by the AMOLED display panel needs to be modulated according to a given gamma standard curve, so that each class brightness of the AMOLED display panel matches the gamma standard curve, thereby ensuring that the AMOLED display panel may accurately display the details of the image with different brightness when displaying an image. Gamma voltage is a voltage set according to the given gamma standard curve and used for a gray scale display of the AMOLED display panel. The gamma voltage converts a digital signal generated by a timing controller into an analog signal corresponding to the gray scale voltage under the action of a digital-to-analog converter of a display driving chip, and then the analog signal is input to the AMOLED display panel, so as to realize the image display.

SUMMARY

In a first aspect, an embodiment of the present disclosure provides a method for adjusting a gamma voltage of a curved display panel, and the method includes:

determining a first gamma voltage in a situation that a planar display region of the curved display panel is horizontally placed and in a white balance state;

dividing a curved display region of the curved display panel into a plurality of sub-regions according to a bending degree of the curved display region of the curved display panel, and determining a plurality of inclined angles in a one-to-one correspondence with bending degrees of the plurality of sub-regions;

determining a plurality of second gamma voltages in a one-to-one correspondence with the plurality of inclined angles in a situation that the planar display region of the curved display panel is tilted at the plurality of inclined angles relative to a position where the planar display region is horizontally placed and the planar display region is in the white balance state; and using the first gamma voltage as a gamma voltage of the planar display region of the curved display panel, and using each of the plurality of second gamma voltages as a gamma voltage of a corresponding sub-region of the plurality of sub-regions.

In an implementation, dividing the curved display region of the curved display panel into a plurality of sub-regions according to the bending degree of the curved display region of the curved display panel includes:

according to the bending degree of the curved display region of the curved display panel, dividing the curved display region of the curved display panel into a plurality of sub-regions which decrease in area in turn as bending degrees of the plurality of sub-regions increase in turn; and/or, according to the bending degree of the curved display region of the curved display panel, dividing the curved display region of the curved display panel into a plurality of sub-regions which increase in number as the bending degree of the curved display region increases.

In an implementation, determining the plurality of inclined angles in a one-to-one correspondence with the bending degrees of the plurality of sub-regions includes:

determining an included angle between a tangent plane of each of the plurality of sub-regions and the planar display region as a corresponding inclined angle of the plurality of inclined angles, the included angle being an acute angle.

In an implementation, determining the first gamma voltage, or determining the plurality of second gamma voltages in a one-to-one correspondence with the plurality of inclined angles, includes:

measuring a brightness value of the planar display region of the curved display panel in a display of each of gray scales, and generating a corresponding gamma curve; and using a gamma voltage, which corresponds to the gamma curve when the gamma curve overlaps with a gamma standard curve, as the first gamma voltage; or using a plurality of gamma voltages, each of which corresponds to the gamma curve when the gamma curve overlaps with the gamma standard curve, as the plurality of second gamma voltages in a one-to-one way.

In an implementation, in the situation that the planar display region of the curved display panel is tilted at the plurality of inclined angles relative to the position where the planar display region is horizontally placed, before measuring the brightness value of the planar display region of the curved display panel in the display of each of gray scales, the method further includes:

determining a first color coordinate of the planar display region of the curved display panel in the situation that the planar display region of the curved display panel is horizontally placed and in the white balance state;

determining a plurality of second color coordinates of the planar display region of the curved display panel in a one-to-one correspondence with the plurality of inclined angles in the situation that the planar display region of the curved display panel is tilted at the plurality of inclined angles relative to the position where the planar display region is horizontally placed and the planar display region is in the white balance state;

determining whether a color cast value of each of the plurality of second color coordinates relative to the first color coordinate is within a given color cast specification range;

if the color cast value of a second color coordinate of the plurality of second color coordinates relative to the first color coordinate is within the given color cast specification range, using the first gamma voltage as a corresponding second gamma voltage of the plurality of gamma voltages; and if the color cast value of a second color coordinate of the plurality of second color coordinates relative to the first color coordinate is not within the given color cast specification range, performing a measurement of a brightness value of the planar display region of the curved display panel in the display of each of gray scales.

In an implementation, determining the color cast value of each of the plurality of second color coordinates relative to the first color coordinate includes:

calculating a color cast value Δu'v' of each of the plurality of second color coordinates relative to the first color coordinate according to the following formula:

$$\Delta u'v'=[(u'-u_0')^2+(v'-v_0')^2]^{1/2}$$

where $u_0'$ represents a x coordinate value of the first color coordinate, $v_0'$ represents a y coordinate value of the first color coordinate, u' represents a x coordinate value of each of the plurality of second color coordinates, and v' represents a y coordinate value of each of the plurality of second color coordinates.

In a second aspect, an embodiment of the present disclosure provides a device for adjusting a gamma voltage of a curved display panel. The device includes:

a first determiner configured to determine a first gamma voltage in a situation that a planar display region of the curved display panel is horizontally placed and in a white balance state;

a divider configured to divide a curved display region of the curved display panel into a plurality of sub-regions according to a bending degree of the curved display region of the curved display panel, and to determine a plurality of inclined angles in a one-to-one correspondence with bending degrees of the plurality of sub-regions;

a second determiner configured to determine a plurality of second gamma voltages in a one-to-one correspondence with the plurality of inclined angles in a situation that the planar display region of the curved display panel is tilted at the plurality of inclined angles relative to a position where the planar display region is horizontally placed and the planar display region is in the white balance state; and an adjuster configured to use the first gamma voltage as a gamma voltage of the planar display region of the curved display panel, and to use each of the plurality of second gamma voltages as a gamma voltage of a corresponding sub-region of the plurality of sub-regions.

In an implementation, the divider is configured to, according to the bending degree of the curved display region of the curved display panel, divide the curved display region of the curved display panel into a plurality of sub-regions which decrease in area in turn as bending degrees of the plurality of sub-regions increase in turn; and/or, to, according the bending degree of the curved display region of the curved display panel, divide the curved display region of the curved display panel into a plurality of sub-regions which increase in number as the bending degree of the curved display region increases.

In an implementation, the divider is configured to determine an included angle between a tangent plane of each of the plurality of sub-regions and the planar display region as a corresponding inclined angle of the plurality of inclined angles, the included angle being an acute angle.

In an implementation, the first determiner and the second determiner are configured to measure a brightness value of the planar display region of the curved display panel in the display of each of gray scales, to generate a corresponding gamma curve, and to use a gamma voltage, which corresponds to the gamma curve when the gamma curve overlaps a gamma standard curve, as the first gamma voltage or to use a plurality of gamma voltages, each of which corresponds to the gamma curve when the gamma curve overlaps with the gamma standard curve, as the plurality of second gamma voltages in a one-to-one way.

In an implementation, the second determiner is configured to:

determine a first color coordinate of the planar display region of the curved display panel in the situation that the planar display region of the curved display panel is horizontally placed and in white balance state;

determine a plurality of second color coordinates of the planar display region of the curved display panel in a one-to-one correspondence with the plurality of inclined angles in the situation that the planar display region of the curved display panel is tilted at the plurality of inclined angles relative to the position where the planar display region is horizontally placed and the planar display region is in the white balance state;

determine whether a color cast value of each of the plurality of second color coordinates relative to the first color coordinate is within a given color cast specification range;

if the color cast value of a second color coordinate of the plurality of second color coordinates relative to the first color coordinate is within a given color cast specification range, use the first gamma voltage as a corresponding second gamma voltage of the plurality of gamma voltages; and if the color cast value of a corresponding color coordinate of the plurality of second color coordinates relative to the first color coordinate is not within the given color cast specification range, perform a measurement of a brightness value of the planar display region of the curved display panel in the display of each of gray scales.

In an implementation, the second determiner is configured to calculate a color cast value Δu'v' of each of the plurality of second color coordinates relative to the first color coordinate according to a formula:

$$\Delta u'v'=[(u'-u_0')^2+(v'-v_0')^2]^{1/2}$$

where $u_0'$ represents a x coordinate value of the first color coordinate, $v_0'$ represents a y coordinate value of the first color coordinate, u' represents a x coordinate value of each of the plurality of second color coordinates, and v' represents a y coordinate value of each of the plurality of second color coordinates.

In a third aspect, an embodiment of the present disclosure provides a device for adjusting a gamma voltage of a curved display panel. The device includes:

a memory storing program instructions; and a processor, wherein the program instructions, when executed by the processor, cause the processor to:

determine a first gamma voltage in a situation that a planar display region of the curved display panel is horizontally placed and in a white balance state;

divide a curved display region of the curved display panel into a plurality of sub-regions according to a bending degree of the curved display region of the curved display panel, and determine a plurality of inclined angles in a one-to-one correspondence with bending degrees of the plurality of sub-regions;

determine a plurality of second gamma voltages in a one-to-one correspondence with the plurality of inclined angles in a situation that the planar display region is tilted at the plurality of inclined angles relative a position where the planar display region is horizontally placed and the planar display region is in the white balance state; and use the first gamma voltage as a gamma voltage of the planar display region, and use each of the plurality of second gamma voltages as a gamma voltage of a corresponding sub-region of the plurality of sub-regions.

In an implementation, the program instructions, when executed by the processor, cause the processor to, according to the bending degree of the curved display region of the curved display panel, divide the curved display region of the curved display panel into a plurality of sub-regions which decrease in area in turn as bending degrees of the plurality of sub-regions increase in turn; and/or, to, according to the bending degree of the curved display region of the curved display panel, divide the curved display region of the curved display panel into a plurality of sub-regions which increase in number as the bending degree of the curved display region increases.

In an implementation, the program instructions, when executed by the processor, cause the processor to determine an included angle between a tangent plane of each of the plurality of sub-regions and the planar display region as a corresponding inclined angle of the plurality of inclined angles, the included angle being an acute angle.

In an implementation, the program instructions, when executed by the processor, cause the processor to:

measure a brightness value of the planar display region of the curved display panel in a display of each of gray scales, and generate a corresponding gamma curve; and use a gamma voltage, which corresponds to the gamma curve when the gamma curve overlaps with a gamma standard curve, as the first gamma voltage; or use a plurality of gamma voltages, each of which corresponds to the gamma curve when the gamma curve overlaps with the gamma standard curve, as the plurality of second gamma voltages in a one-to-one way.

In an implementation, the program instructions, when executed by the processor, cause the processor to:

determine a first color coordinate of the planar display region of the curved display panel in the situation that the planar display region of the curved display panel is horizontally placed and in white balance state;

determine a plurality of second color coordinates of the planar display region of the curved display panel in a one-to-one correspondence with the plurality of inclined angles in the situation that the planar display region of the curved display panel is tilted at the plurality of inclined angles relative to the position where the planar display region is horizontally placed and the planar display region is in the white balance state;

determine whether a color cast value of each of the plurality of second color coordinates relative to the first color coordinate is within a given color cast specification range;

if the color cast value of a second color coordinate of the plurality of second color coordinates relative to the first color coordinate is within the given color cast specification range, use the first gamma voltage as a corresponding second gamma voltage of the plurality of gamma voltages; and if the color cast value of a second color coordinate of the plurality of second color coordinates relative to the first color coordinate is not within the given color cast specification range, perform a measurement of a brightness value of the planar display region of the curved display panel in the display of each of gray scales.

In an implementation, the program instructions, when executed by the processor, cause the processor to calculate a color cast value Δu'v' of each of the plurality of second color coordinates relative to the first color coordinate according to a formula:

$$\Delta u'v' = [(u' - u_0')^2 + (v' - v_0')^2]^{1/2}$$

where $u_0'$ represents a x coordinate value of the first color coordinate, $v_0'$ represents a y coordinate value of the first color coordinate, u' represents a x coordinate value of each of the plurality of second color coordinates, and v' represents a y coordinate value of each of the plurality of second color coordinates.

In a fourth aspect, an embodiment of the present disclosure provides a computer non-transitory readable storage medium, and the medium stores computer programs which, after being loaded into a processor, cause the processor to perform the method for adjusting a gamma voltage of the curved display panel as described above.

In a fifth aspect, an embodiment of the present disclosure provides a computer program product which, when executed by a processor, performs the method for adjusting a gamma voltage of the curved display panel as described above.

BRIEF DESCRIPTION OF THE DRAWINGS

In order to describe technical solutions in embodiments of the present disclosure more clearly, the accompanying drawings to be used in the description of embodiments will be introduced briefly. Obviously, the accompanying drawings to be described below are merely some embodiments of the present disclosure, and a person of ordinary skill in the art can obtain other drawings according to those drawings without paying any creative effort.

DETAILED DESCRIPTION

Specific implementations of a method and a device for adjusting a gamma voltage of a curved display panel provided by the embodiments of the present disclosure are described in detail below with reference to the accompanying drawings.

Figure 1:
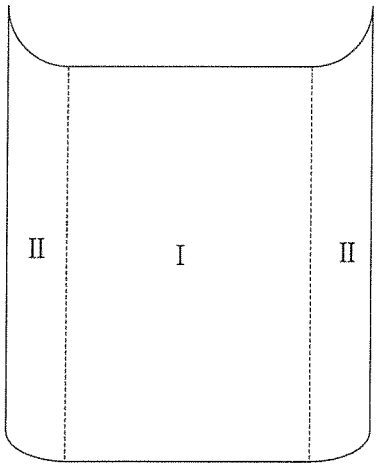
Fig. 1 ( PRIOR ART )
FIG. 1 is a schematic view of color cast phenomenon appeared in different display regions of a curved display panel.

In a rigid product based on a normal AMOLED, display regions of a display panel are in the same plane, gamma voltages output to the AMOLED are the same value after a gamma tuning process, and the display regions are all in a white balance state. Therefore, in the case of the front view, there is no color cast phenomenon. However, in current flexible display products based on an AMOLED, both sides of the display panel are curved, leading its curved display regions to exhibit radians with different curvatures. If a same gamma voltage is input to all the display regions, a significant color cast phenomenon may occur in the curved display regions. That is, viewing from different angles, there may be different degrees of color cast in different positions of the display panel. For example, as shown in FIG. 1, in the case of the front view, if the planar display region I of the curved display panel 1 is in a white balance state, a color cast phenomenon may occur in the curved display regions II of the curved display panel 1. In addition, in the case of the side view, if the curved display region II of the curve display panel 1 is in a white balance state, a color cast phenomenon may occur in the planar display region I of the curve display panel 1. It can be seen that the overall display color effects of the display panel in the above two cases are quite different, which may affect display quality of the display panel.

Therefore, how to adjust the gamma voltage so as to improve the display quality of the curved display panel is a technical problem to be solved by those skilled in the art.

In order to solve the above technical problem, the embodiments of the present disclosure provide a method and a device for adjusting a gamma voltage of the curved display panel to solve the problem of how to adjust the gamma voltage in the prior art so as to improve the display quality of the curved display panel.

The embodiments of present disclosure have the following beneficial effects.

The embodiments of the present disclosure provide a method and a device for adjusting a gamma voltage of a curved display panel. The method includes the following steps. A first gamma voltage is determined in a situation that a planar display region of the curved display panel is horizontally placed and in the white balance state, and a curved display region of the curved display panel is divided into a plurality of sub-regions according to a bending degree of the curved display region of the curved display panel. In turn, a plurality of inclined angles in a one-to-one correspondence with the bending degrees of the plurality of sub-regions are determined, and a plurality of second gamma voltages in a one-to-one correspondence with the plurality of inclined angles are determined in a situation that the planar display region of the curved display panel is tilted at the plurality of inclined angles relative to a position where the planar display region is horizontally placed and the planar display region is in the white balance state. Then the first gamma voltage is used as a gamma voltage of the planar display region of the curved display panel, and each of the plurality of second gamma voltages is used as a gamma voltage of a corresponding sub-region of the plurality of sub-regions. Since the first gamma voltage and the second gamma voltages are used as the gamma voltage of the planar display region and the gamma voltages of the sub-regions of the curved display region of the curved display panel, respectively, if the curved display panel displays an image, its planar display region and curved display region may be both in white balance state, and no color cast phenomenon may occur. Thus, the display quality of the curved display panel may be improved.

Figure 2A:
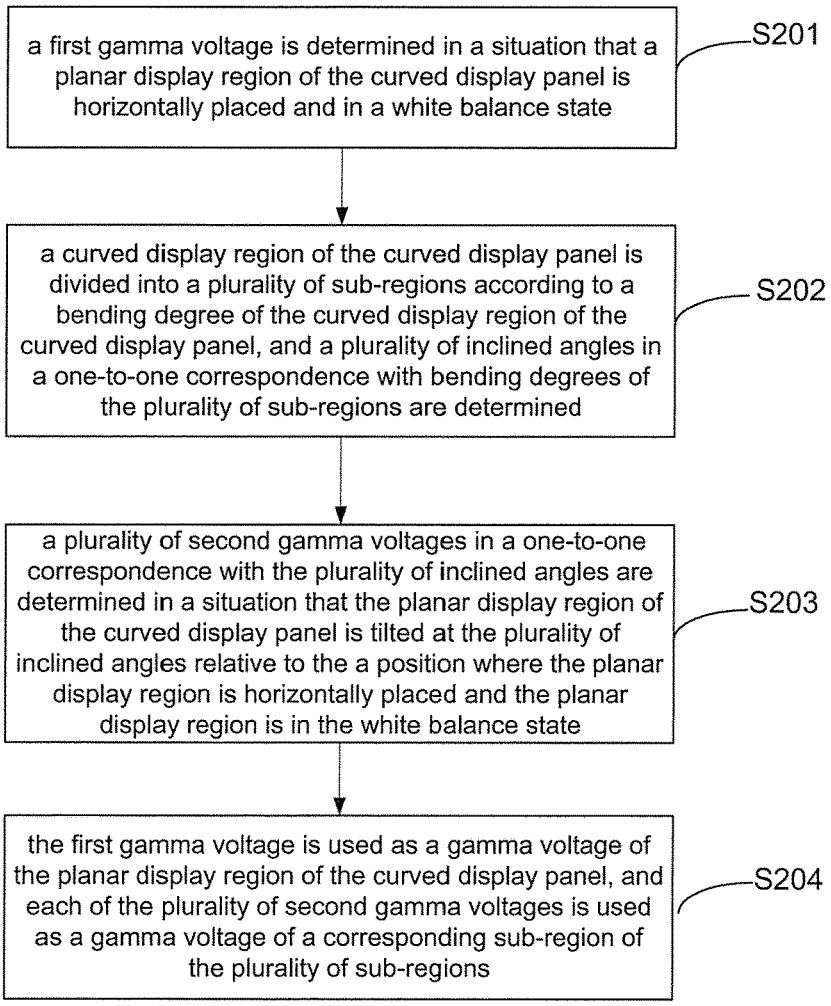
FIGS. 2*a* and 2*b* are flowcharts showing methods for adjusting a gamma voltage of a curved display panel provided by the embodiments of the present disclosure, respectively.
Figure 2B:
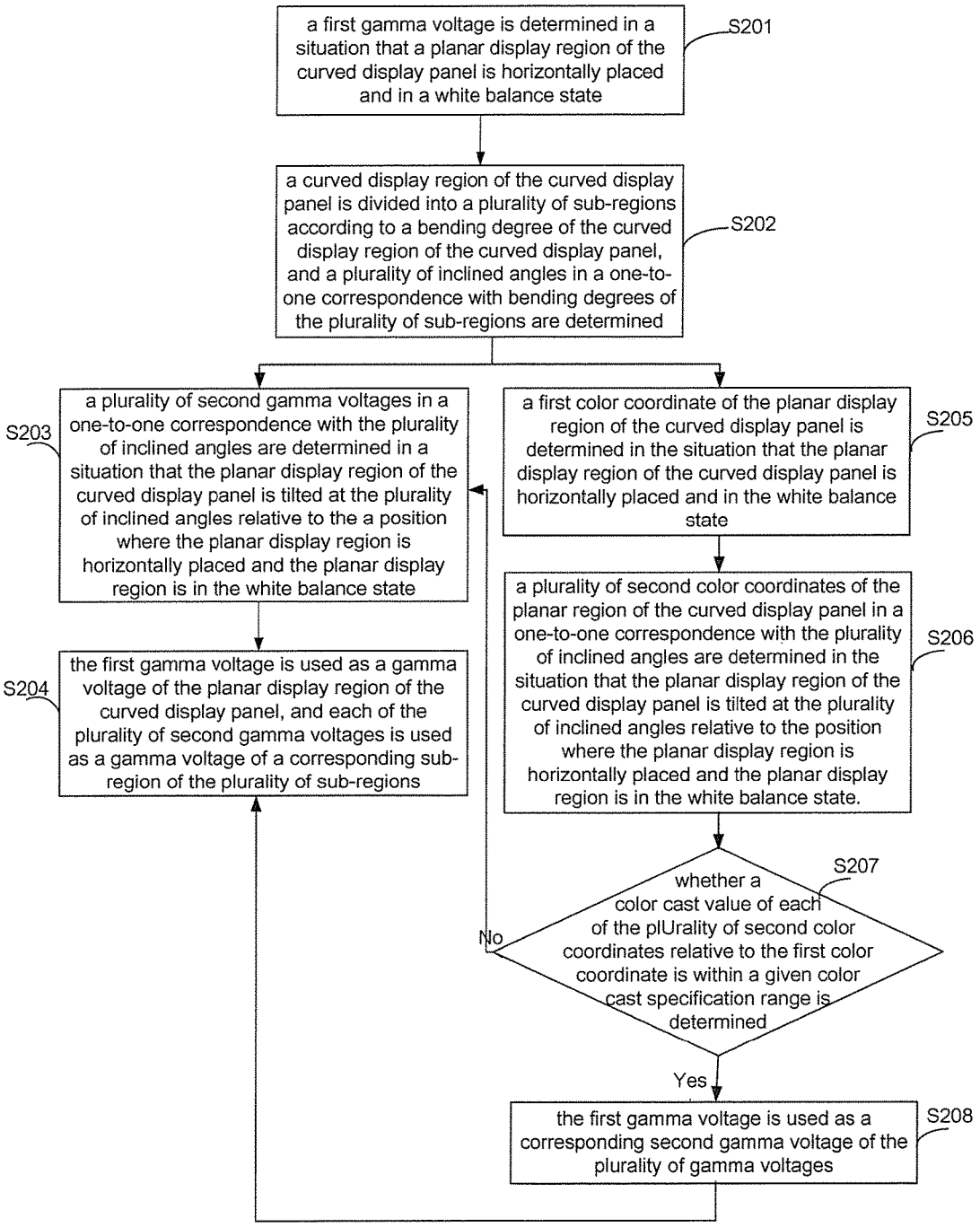

An embodiment of the present disclosure provides a method for adjusting a gamma voltage of the curved display panel. As shown in FIGS. 2*a* and 2*b*, the method may include the following steps 201 to 204.

In step 201 (S201), a first gamma voltage is determined in a situation that a planar display region of the curved display panel is horizontally placed and in a white balance state.

In step 202 (S202), a curved display region of the curved display panel is divided into a plurality of sub-regions according to a bending degree of the curved display region of the curved display panel, and a plurality of inclined angles in a one-to-one correspondence with bending degrees of the plurality of sub-regions are determined.

In step 203 (S203), a plurality of second gamma voltages in a one-to-one correspondence with the plurality of inclined angles are determined in a situation that the planar display region of the curved display panel is tilted at the plurality of inclined angles relative to the a position where the planar display region is horizontally placed and the planar display region is in the white balance state.

In step 204 (S204), the first gamma voltage is used as a gamma voltage of the planar display region of the curved display panel, and each of the plurality of second gamma voltages is used as a gamma voltage of a corresponding sub-region of the plurality of sub-regions.

In the above method for adjusting gamma voltages provided by the embodiment of the present disclosure, the first gamma voltage and the plurality of second gamma voltages are used as the gamma voltage of the planar display region and the gamma voltages of the sub-regions of the curved display region of the curved display panel, respectively. Therefore, when the curved display panel displays an image, its planar display region and curved display region may be both in white balance state, and no color cast phenomenon may occur. Therefore, the display quality of the curved display panel may be improved.

In general, the greater the bending degree of the curved display region of the curved display panel, the more serious the color cast phenomenon in the curved display region. Therefore, in order to avoid the color cast phenomenon in the curved display region as much as possible, in an embodiment of the present disclosure, the step 202 that a curved display region of the curved display panel is divided into a plurality of sub-regions according to a bending degree of the curved display region of the curved display panel may be implemented by any one of the following three methods.

Firstly, according to the bending degree of the curved display region of the curved display panel, the curved display region of the curved display panel is divided into a plurality of sub-regions which decrease in area in turn as the degrees of the sub-regions increase in turn.

Figure 3A:
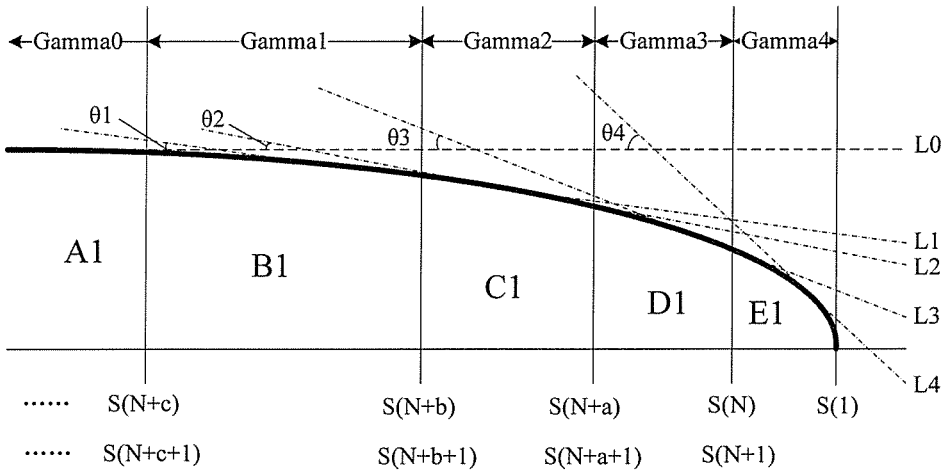
FIGS. 3*a* and 3*b* are schematic diagrams of dividing a curved display region of a curved display panel into a plurality of sub-regions provided by the embodiments of the present disclosure, respectively.

For example, as shown in FIG. 3*a*, according to the bending degree of a curved display region of the curved display panel, the curved display region of the curved display panel is divided into four sub-regions, i.e., sub-regions B1, C1, D1 and E1. Moreover, the bending degrees of the sub-regions E1, D1, C1 and B1 decrease in turn, and the areas of the sub-region E1, D1, C1 and B1 increase in turn.

Secondly, according to the bending degree of the curved display region of the curved display panel, the curved display region of the curved display panel is divided into a plurality of sub-regions which increase in number as the bending degree of the curved display region increase.

Figure 3B:
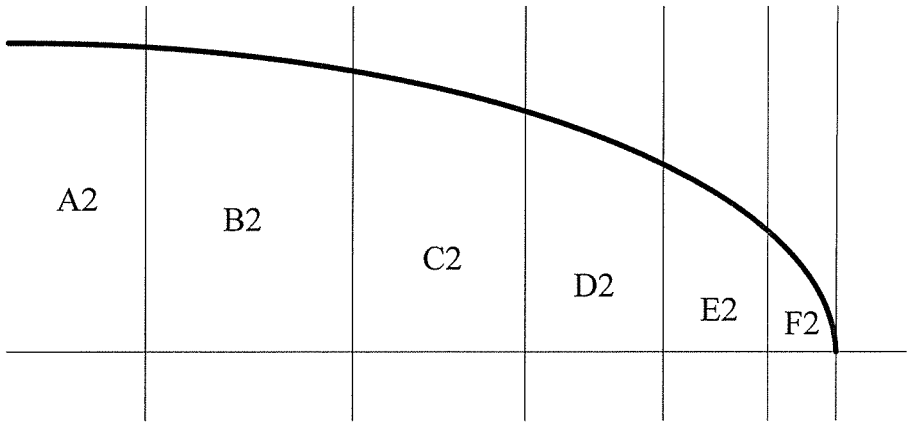

For example, as shown in FIGS. 3*a* and 3*b*, it can be seen that the curved display region of the curved display panel in FIG. 3*b* has a greater bending degree than that of the curved display region of the curved display panel in FIG. 3*a*. Correspondingly, the bending degree of each of sub-regions obtained by dividing the curved display region of the curved display panel in FIG. 3*b* is greater than that of a corresponding sub-region of sub-regions obtained by dividing the curved display region of the curved display panel in FIG. 3*a*. Thus it can be seen that the bending degree of the sub-region F2 is greater than that of the sub-region E1, the bending degree of the sub-region E2 is greater than that of the sub-region D1, the bending degree of the sub-region D2 is greater than that of the sub-region C1, and the bending degree of the sub-region C2 is greater than that of the sub-region B1. Moreover, the curved display region of the curved display panel in FIG. 3*b* is divided into five sub-regions, i.e., sub-regions B2, C2, D2, E2 and F2. However, the curved display region of the curved display panel in FIG. 3*a* is divided into four sub-regions, i.e., sub-regions B1, C1, D1 and E1.

Thirdly, according to the bending degree of the curved display region of the curved display panel, the curved display region of the curved display panel is divided into a plurality of sub-regions which decrease in area in turn as the bending degrees of the plurality of sub-regions increase in turn and which increase in number as the bending degree of the curved display region increases.

It should be noted that, in order to reduce the workload of the step 203 of determining the plurality of second gamma voltages in the situation that the planar display region of the curved display panel is tilted at the plurality of inclined angles relative to the position where the planar display region is horizontally placed and the planar display region is in the white balance state, when the curved display region of the curved display panel is divided, a criterion that no color cast phenomenon occurs in each of the plurality of sub-regions should be taken so as to obtain an appropriate number of sub-regions.

Furthermore, in an embodiment of the present disclosure, after the step 202 that a curved display region of the curved display panel is divided into a plurality of sub-regions and a plurality of inclined angles in a one-to-one correspondence with the bending degrees of the sub-regions may be determined in the following way.

An included angle between a tangent plane of each of the plurality of sub-regions and the planar display region is determined as a corresponding inclined angle of the plurality of inclined angles, wherein the included angle is an acute angle.

For example, as shown in FIG. 3*a*, an acute angle θ1 between a tangent plane L1 of the sub-region B1 and the planar display region A1 (i.e., an level surface L0 parallel to the planar display region A1 as shown in FIG. 3*a*) is determined to be an inclined angle matching the bending degree of the sub-region B1. An acute angle θ2 between a tangent plane L2 of the sub-region C1 and the planar display region A1 is determined to be an inclined angle matching the bending degree of the sub-region C1. An acute angle θ3 between a tangent plane L3 of the sub-region D1 is determined to be an inclined angle matching the bending degree of the sub-region D1. In addition, an acute angle θ4 between a tangent plane L4 of the sub-region E1 is determined to be an inclined angle matching the bending degree of the sub-region E1.

In an implementation, an included angle between a tangent plane of each of sub-regions and the planar display region may be taken as an inclined angle matching the bending degree of the correspond sub-region. In another implementation, the curved display panel may be placed horizontally on a carrier, and whether color cast phenomenon of each of sub-regions exists is observed by testing through a special optical instrument or by naked eye after the carrier is adjusted to be inclined at different angles. In addition, the angles of the carrier inclined when the color cast phenomenon of each of sub-regions does not exist are respectively used as the inclined angles that match the bending degrees of the sub-regions.

A gamma curve (a curve corresponding to the gamma value) of the display panel reflects a relationship between a gray scale and a brightness of a display image of the display panel, and there is a well-established gamma curve requirement standard in the industry corresponding to such as a gamma value of 2.0 or 2.2. Generally, the gamma curve with the gamma value of 2.2 is selected as a gamma standard curve of the display panel as the brightness of the display image output by the display panel meeting this standard is approximately linear in human perception, and thus a better display effect may be obtained.

In order to clearly illustrate the technical solutions of the embodiments of the present disclosure, the gamma standard curve with the gamma value of 2.2 will be introduced below first.

Figure 4:
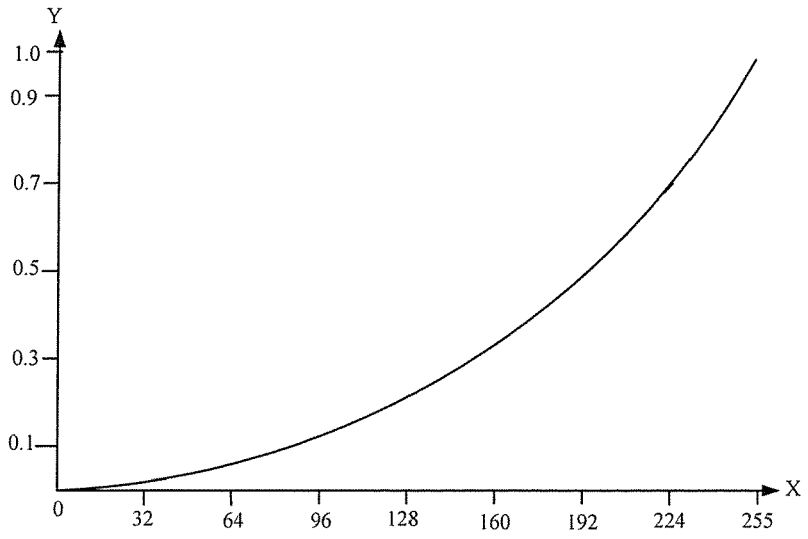
FIG. 4 is a schematic diagram of a gamma standard curve with a gamma value of 2.2 in the prior art.

FIG. 4 shows the gamma standard curve with the gamma value of 2.2, where the X axis represents the gray scale L (which has a range from 0 to 255), and the Y axis represents a transmittance of the display panel (i.e., a normalized brightness). The function expression of the gamma standard curve with the gamma value of 2.2 is $Y=(L/255)^{2.2}$, and a scale L corresponds to a gray scale voltage.

If the gamma curve of the display panel meets the requirement of the gamma standard curve with the gamma value of 2.2, the display panel displays an image with a better light and shade effect, and the gray scales reflected in the human eye are relatively evenly distributed. If the gamma curve of the display panel does not meet the requirement of the gamma standard curve with the gamma value of 2.2, the display device may display an image with a poor light and shade effect, and the gray scales reflected in the human eye may be distributed unevenly.

In an embodiment of the present disclosure, the step 201 that the first gamma voltage is determined and the step 203 that the plurality of second gamma voltages are determined may be implemented in the following ways.

A brightness value of the planar display region of the curved display panel in the display of each of gray scales is measured, and then a corresponding gamma curve is generated. A gamma voltage, which corresponds to the gamma curve when the gamma curve overlaps with a gamma standard curve, is used as the first gamma voltage. Alternatively, a plurality of gamma voltages, each of which corresponds to the gamma curve when the gamma curve overlaps with the gamma standard curve are used as the plurality of second gamma voltages in a one-to-one way.

In an embodiment of the present disclosure, if the gamma standard curve with the gamma value of 2.2 is selected, for the curved display panel of a 255-gray scale, step 201 that a first gamma voltage is determined may be implemented as follows.

A plurality of gray scale images, which are from 0-th gray scale to 255-th gray scale respectively, may be displayed by the planar display region of the curved display panel respectively, and then a display brightness value of each of the plurality of gray scale images is detected, thereby forming a gamma curve of the plurality of gray scale images of the curved display panel from 0-th gray scale to 255-th gray scale. Subsequently, the gamma curve formed is compared with the gamma standard curve with the gamma value of 2.2 and the gamma voltage is adjusted according to the comparison result so as to adjust the display brightness value of each of the gray scale images, so that the gamma curve of the planar display region of the curved display panel accords with the gamma standard curve with the gamma value of 2.2. In addition, a gamma voltage, which corresponds to the gamma curve of the planar display region of the curved display panel when the gamma curve meets the gamma standard curve with the gamma value of 2.2, is used as the first gamma voltage in white balance state.

In an embodiment of the present disclosure, the specific process of determining the gamma voltage is similar to that in step 201 of determining a first gamma voltage. For example, the specific process of the step 203 of determining each of second gamma voltages is similar to that of the step 201 of determining a first gamma voltage, and details are not described herein again.

In an embodiment of the present disclosure, the first gamma voltage determined in the step 201 is a gamma voltage at the center of the planar display region in the situation that the planar display region of the curved display panel is horizontally placed and in the white balance state. In addition, each of the second gamma voltages determined in the step 203 is a corresponding second gamma voltage of the second gamma voltages at the center of the planar display region in the situation the planar display region of the curved display panel is tilted at the plurality of inclined angles relative to the position where the curved display region is placed horizontally and the planar display region is in the white balance state.

In an embodiment of the present disclosure, the method for adjusting a gamma voltage provided by the embodiments of the present disclosure are described by taking the curved display panel divided into the planar display region and the four sub-regions shown in FIG. 3*a* as an example. In FIG. 3*a*, Gamma0 is the gamma voltage of the planar display region A1 of the curved display panel, and Gamma1, Gamma2, Gamma3 and Gamma4 are the gamma voltages of the sub-regions B1, C1, D1 and E1, respectively.

Furthermore, Gamma0 is the first gamma voltage determined when the planar display region A1 of the curved display panel is horizontally placed, i.e., when the planar display region A1 is parallel to the horizontal surface L0, and in the white balance state. Gamma1, Gamma2, Gamma3, and Gamma4 are respectively the second gamma voltages determined when the planar display region A1 of the curved display panel is tilted at the plurality of inclined angles relative to the position where the planar display panel is placed horizontally and when the planar display panel is in the white balance state. In addition, the inclined angles are the acute angle between the tangent plane of the sub-region B1 and the planar display region A1, the acute angle between the sub-region C1 and the planar display region A1, the acute angle between the sub-region D1 and the planar display region A1, and the acute angle between the sub-region E1 and the planar display region A1, respectively. That is, as shown in FIG. 3*a*, assuming that the included angles θ1 between the tangent plane L1 of the sub-region B1 and the planar display region A1 (i.e., the horizontal surface L0 parallel to the planar display region A1 as shown in FIG. 3*a*), θ2 between the tangent plane L2 of the sub-region C1 and the planar display region A1, θ3 between the tangent plane L3 of the sub-region D1 and the planar display region A1, and θ4 between the tangent plane L4 of the sub-region E1 and the planar display region A1 are ±10°, ±20°, ±30° and ±40°, respectively, Gamma1, Gamma2, Gamma3 and Gamma4 are respectively the second gamma voltages determined when the planar display region A1 of the curved display panel is tilted at ±10°, ±20°, ±30° and ±40° relative to the position where the planar display region A1 is placed horizontally, and when the planar display region A1 is in the white balance state.

The Gamma0 of the planar display region A1 of the curved display panel is held, the Gamma4 corresponding to the sub-region E1 is written into lines S(1)-S(N), the Gamma3 corresponding to the sub-region D1 is written into lines S(N+1)-S(N+a), the Gamma2 corresponding to the sub-region C1 is written into lines S(N+a+1)-S(N+b), and the Gamma1 corresponding to the sub-region B1 is written into lines S(N+b+1)-S(N+c). In addition, a same gamma voltage corresponding to the same position on the curved display regions on the left and right sides of the curved display panel is written into the same line. Then, Gamma0, Gamma1, Gamma2, Gamma3 and Gamma4 are output to the display driver chip as a final display output of the curved display panel. So far, the adjustment of the gamma voltage of the curved display panel is completed.

In an embodiment of the present disclosure, as shown in FIG. 2*b*, in order to further improve the production efficiency, in the situation that the planar display region A1 of the curved display panel is tilted at the plurality of inclined angles relative to the position where the planar display region is horizontally placed, before the step 203 of measuring a brightness value of the planar display region of the curved display panel in the display of each of gray scales, the method for adjusting a gamma voltage may further includes the following steps 205-207.

In step 205 (S205), a first color coordinate of the planar display region of the curved display panel is determined when the planar display region of the curved display panel is driven by the first gamma voltage in the situation that the planar display region of the curved display panel is horizontally placed and in the white balance state;

In step 206, a plurality of second color coordinates of the planar region of the curved display panel in a one-to-one correspondence with the plurality of inclined angles are determined when the planar display region of the curved display panel is driven by the first gamma voltage in the situation that the planar display region of the curved display panel is tilted at the plurality of inclined angles relative to the position where the planar display region is horizontally placed and the planar display region is in the white balance state.

In step 207 (S207), whether a color cast value of each of the plurality of second color coordinates relative to the first color coordinate is within a given color cast specification range is determined.

If the color cast value of a second color coordinate of the plurality of second color coordinates relative to the first color coordinate is within the given color cast specification range, a step 208 is performed, i.e., the first gamma voltage is used as a corresponding second gamma voltage of the plurality of gamma voltages.

If the color cast value of a second color coordinate of the plurality of second color coordinates relative to the first color coordinate is not within the given color cast specification range, a measurement of a brightness value of the planar display region of the curved display panel in the display of each of gray scales is performed, i.e., the step S203 is performed.

In this way, whether the color cast value of each second color coordinates relative to the first color coordinate is within the given color cast specification range is determined, and then when the color cast value is determined to be within the given color cast specification range, the first gamma voltage is used as a corresponding second gamma voltage of the plurality of gamma voltages in the situation that the planar display region of the curved display panel is tilted at a inclined angle relative to the position where the curved display region is horizontally placed and the planar display region is in the white balance state, so as to avoid the processes of measuring and adjusting the second gamma voltages respectively corresponding to the sub-regions. Therefore, the workload of adjusting the gamma voltage of the curved display panel may be reduced, and thus the production efficiency may be improved.

It should be noted that in the above method for adjusting the gamma voltage provided in the embodiments of the present disclosure, the order of steps 201, 202, 205 and 206 is not limited to the above sequence, and in an implementation, these steps are also in the order of step 201→step 205→step 202→step 206, or in the order of step 201→step 202→step 206→step 205, which is not limited herein.

In an embodiment of the present disclosure, the color cast value of each of the plurality of second color coordinates relative to the first color coordinate may be determined in the following way.

A color cast value Δu'v' of each of the plurality of second color coordinates relative to the first color coordinate is calculated according to the following formula:

$$\Delta u'v'=[(u'-u_0')^2+(v'-v_0')^2]^{1/2}$$

Where $u_0'$ represents a x coordinate value of the first color coordinate; $v_0'$ represents a y coordinate value of the first color coordinate; u' represents a x coordinate value of each of the plurality of second color coordinates; and v' represents a y coordinate value of each of the plurality of second color coordinates.

It should be noted that the method for adjusting the gamma voltage of the curved display panel provided by the embodiments of the present disclosure is applicable not only to a bendable organic electroluminescent display panel (OLED) but also to a light emitting diode display (LED) panel, a liquid crystal display (LCD) panel, an electronic paper display panel, a plasma display panel, an electrophoretic display panel, a quantum dot light emitting display (QLED) panel, a micro light emitting diode display (mLED) panel, or a light emitting diode display panel, which have a curved display region, which is not limited herein.

Based on the same concept, an embodiment of the present disclosure provides a device 50 for adjusting a gamma voltage of the curved display panel.

Figure 5:
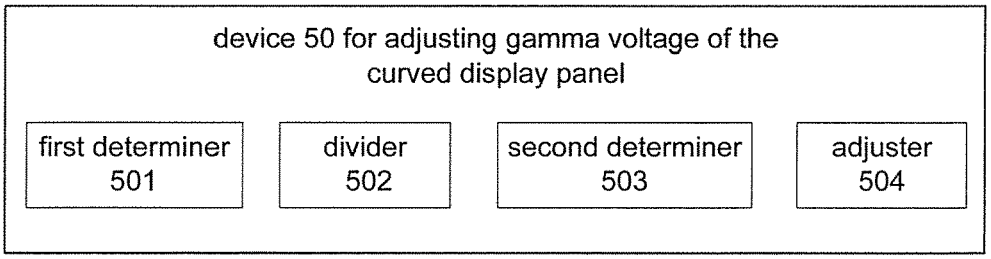
FIG. 5 is a schematic structural diagram of a device for adjusting gamma voltage of a curved display panel provided by the embodiments of the present disclosure.

As shown in FIG. 5, the device 50 includes a first determiner 501, a divider 502, a second determiner 503, and an adjuster 504. The first determiner 501 is configured to determine a first gamma voltage in a situation that a planar display region of the curved display panel is horizontally placed and in a white balance state. The divider 502 is configured to divide a curved display region of the curved display panel into a plurality of sub-regions according to a bending degree of the curved display region of the curved display panel, and to determine a plurality of inclined angles in a one-to-one correspondence with bending degrees of the plurality of sub-regions. The second determiner 503 is configured to determine a plurality of second gamma voltages in a one-to-one correspondence with the plurality of inclined angles in a situation that the planar display region of the curved display panel is tilted at the plurality of inclined angles relative to a position where the planar display region is horizontally placed and the planar display region is in the white balance state. The adjuster 504 is configured to use the first gamma voltage as a gamma voltage of the planar display region of the curved display panel, and to use each of the plurality of second gamma voltages as a gamma voltage of a corresponding sub-region of the plurality of sub-regions.

In an embodiment of the present disclosure, the divider 502 is configured to, according to the bending degree of the curved display region of the curved display panel, divide the curved display region of the curved display panel into a plurality of sub-regions which decrease in area in turn as bending degrees of the sub-regions increase in turn. In another embodiment of the present disclosure, the divider 502 is configured to, according to the bending degree of the curved display region of the curved display panel, divide the curved display region of the curved display panel into a plurality of sub-regions which increase in number as the bending degree of curved display region increases. In a still another embodiment of the present disclosure, the divider 502 is configured to, according to the bending degree of the curved display region of the curved display panel, divide the curved display region of the curved display panel into a plurality of sub-regions which decrease in area in turn as bending degrees of the sub-regions increase in turn and which increase in number as the bending degree of curved display region increases.

Since the principle of solving the problem of the device 50 is similar to that of the method, the implementation of the device for adjusting the gamma voltage provided by the embodiment of the present disclosure may refer to the implementation of the above method for adjusting the gamma voltage, and duplications are not described herein again.

In an embodiment of the present disclosure, the divider 502 is configured to determine an included angle between a tangent plane of each of the plurality of sub-regions and the planar display region as a corresponding inclined angle of the plurality of inclined angles, and the included angle is an acute angle.

In an embodiment of the present disclosure, the first determiner 501 and the second determiner 503 are configured to measure a brightness value of the planar display region of the curved display panel in the display of each of gray scales, and to generate a corresponding gamma curve. In addition, the first determiner 501 and the second determiner 503 are configured to use a gamma voltage, which corresponds to the gamma curve when the gamma curve overlaps with the gamma standard curve, as the first gamma voltage, or to use a plurality of gamma voltages, each of which corresponds to the gamma curve when the gamma curve overlaps with the gamma standard curve, as the plurality of second gamma voltages in a one-to-one way.

In an embodiment of the present disclosure, the second determiner 503 is configured to determine a first color coordinate of the planar display region of the curved display panel when the planar display region is driven by being applied the first gamma voltage in the situation that the planar display region of the curved display panel is horizontally placed and in the white balance state, and to determine a plurality of second color coordinates of the planar display region of the curved display panel in a one-to-one correspondence with the plurality of inclined angles in the situation that the planar display region of the curved display panel is tilted at the plurality of inclined angles relative to the position where the planar display region is horizontally placed and the planar display region is in the white balance state. In addition, the second determiner 503 is configured to determine whether a color cast value of each of the plurality of second color coordinates relative to the first color coordinate is within a given color cast specification range, to use the first gamma voltage as a corresponding gamma voltage of the plurality of gamma voltages if the color cast value of a second color coordinate of the plurality of second color coordinates relative to the first color coordinate is within the given color cast specification range, and to perform a measurement of a brightness value of the planar display region of the curved display panel in the display of each of gray scales if the color cast value of a second color coordinate of the plurality of second color coordinates relative to the first color coordinate is not within the given color cast specification range.

In an embodiment of the present disclosure, the second determiner 503 is configured to calculate a color cast value Δu'v' of each of the plurality of second color coordinates relative to the first color coordinate according to the following formula:

$$\Delta u'v'=[(u'-u_0')^2+(v'-v_0')^2]^{1/2}$$

where $u_0'$ represents a x coordinate value of the first color coordinate; $v_0'$ represents a y coordinate value of the first color coordinate; u' represents a x coordinate value of each of the plurality of second color coordinates; and v' represents a y coordinate value of each of the plurality of second color coordinates.

The device 50 for adjusting the gamma voltage provided by the embodiments of the present disclosure includes the first determiner 501, the divider 502, the second determiner 503, and the adjuster 504. The first determiner 501 is configured to determine the first gamma voltage in a situation that a planar display region of the curved display panel is horizontally placed and in the white balance state. The divider 502 is configured to divide the curved display region of the curved display panel into a plurality of sub-regions according to the bending degree of the curved display region of the curved display panel, and to determine a plurality of inclined angles in a one-to-one correspondence with the bending degrees of the plurality of sub-regions. The second determiner 503 is configured to determine a plurality of second gamma voltages in a one-to-one correspondence with the plurality of inclined angles in a situation that the planar display region of the curved display panel is tilted at the plurality of inclined angles relative to the position where the planar display region is horizontally placed and the planar display region is in the white balance state. The adjuster 504 is configured to determine the first gamma voltage as a gamma voltage of the planar display region of the curved display panel, and to determine each of the second gamma voltages as a gamma voltage of a corresponding sub-region of the plurality of sub-regions. Since the first gamma voltage and the second gamma voltages are respectively used as the gamma voltage of the planar display region and the gamma voltage of the sub-regions of the curved display region of the curved display panel, if the curved display panel displays an image, its planar display region and curved display region will be both in white balance state, without any color cast phenomenon. Thus, the display quality of the curved display panel may be improved.

In addition, in the device for adjusting a gamma voltage provided by the embodiments of the present disclosure, the second determiner 503 is configured to determine a first color coordinate of the planar display region of the curved display panel when the planar display region of the curved display panel is driven by the first gamma voltage in the situation that the planar display region of the curved display panel is horizontally placed and in the white balance state, and to determine a plurality of second color coordinates of the planar display region of the curved display panel in a one-to-one correspondence with the plurality of inclined angles in the situation that the planar display region of the curved display panel is tilted at the plurality of inclined angles relative to the position where the planar display region is horizontally placed and the planar display region is in the white balance state. In addition, the second determiner 503 is configured to determine whether a color cast value of each of the plurality of second color coordinates relative to the first color coordinate is within a given color cast specification range, to use the first gamma voltage as a corresponding gamma voltage of the plurality of gamma voltages if the color cast value of a second color coordinate of the plurality of second color coordinates relative to the first color coordinate is within the given color cast specification range. Therefore, the processes of measuring and adjusting the second gamma voltages respectively corresponding to the sub-regions may be avoided. Therefore, the workload of adjusting the gamma voltage of the curved display panel may be reduced, and thus the production efficiency may be improved.

Figure 6:
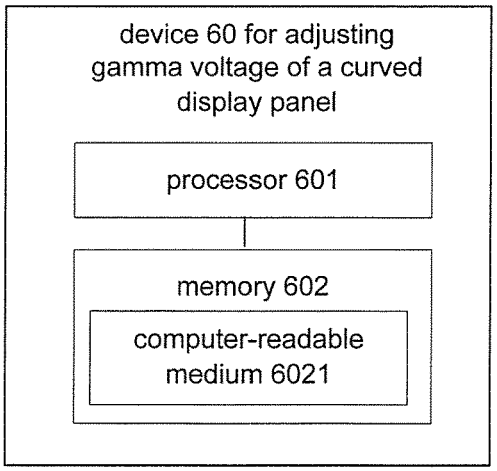
FIG. 6 is a schematic structural diagram of a device for adjusting gamma voltage of a curved display panel provided by the embodiments of the present disclosure

An embodiment of the present disclosure provides a device 60 for adjusting a gamma voltage of a curved display panel. As shown in FIG. 6, the device 60 includes a processor 601 and a memory 602. In an embodiment of the present disclosure, the memory 602 is used for storing program instructions. In an embodiment of the present disclosure, the memory 602 may further include a computer-readable medium 6021.

The program instructions, when executed by the processor 601, cause the processor 601 to determine a first gamma voltage in a situation that a planar display region of the curved display panel is horizontally placed and in a white balance state, to divide a curved display region of the curved display panel into a plurality of sub-regions according to a bending degree of the curved display region of the curved display panel, and to determine a plurality of inclined angles in a one-to-one correspondence with bending degrees of the plurality of sub-regions. In addition, the program instructions, when executed by the processor 601, cause the processor 601 to determine a plurality of second gamma voltages in a one-to-one correspondence with the plurality of inclined angles in a situation that the planar display region is tilted at the plurality of inclined angles relative to a position where the planar display region is horizontally placed and the planar display region is in the white balance state. Furthermore, the program instructions, when executed by the processor, cause the processor to use the first gamma voltage as a gamma voltage of the planar display region, and use each of the plurality of second gamma voltages as a gamma voltage of a corresponding sub-region of the plurality of sub-regions.

In an embodiment of the present disclosure, the sensor may be located inside or outside the device 60.

In an embodiment of the present disclosure, the program instructions, when executed by the processor 601, cause the processor 601 to, according to the bending degree of the curved display region of the curved display panel, divide the curved display region of the curved display panel into a plurality of sub-regions which decrease in area in turn as bending degrees of the sub-regions increase in turn, and/or, to, according to the bending degree of the curved display region of the curved display panel, divide the curved display region of the curved display panel into a plurality of sub-regions which increase in number as the bending degree of the curved display region increases.

In an embodiment of the present disclosure, the program instructions, when executed by the processor, cause the processor to determine an included angle between a tangent plane of each of the plurality of sub-regions and the planar display region as a corresponding inclined angle of the plurality of inclined angles, and the included angle is an acute angle.

In an embodiment of the present disclosure, the program instructions, when executed by the processor 601, cause the processor 601 to measure a brightness value of the planar display region of the curved display panel in the display of each of gray scales, and to generate a corresponding gamma curve. In addition, the program instructions, when executed by the processor 601, cause the processor 601 to use a gamma voltage, which corresponds to the gamma curve when the gamma curve overlaps with the gamma standard curve, as the first gamma voltage, or to use a plurality of gamma voltages, each of which corresponds to the gamma curve when the gamma curve overlaps with the gamma standard curve, as the plurality of second gamma voltages in a one-to-one way.

In an embodiment of the present disclosure, the program instructions, when executed by the processor 601, cause the processor 601 to determine a first color coordinate of the planar display region of the curved display panel in the situation that the planar display region of the curved display panel is horizontally placed and in the white balance state, and to determine a plurality of second color coordinates of the planar display region of the curved display panel in a one-to-one correspondence with the plurality of inclined angles when the planar display region of the curved display panel is driven by the first gamma voltage in the situation that the planar display region of the curved display panel is tilted at the plurality of inclined angles relative to the position where the planar display region is horizontally placed and the planar display region is in the white balance state. In addition, the program instructions, when executed by the processor 601, cause the processor 601 to determine whether a color cast value of each of the plurality of second color coordinates relative to the first color coordinate is within a given color cast specification range, to use the first gamma voltage as a corresponding gamma voltage of the plurality of gamma voltages if the color cast value of a second color coordinate of the plurality of second color coordinates relative to the first color coordinate is within the given color cast specification range, and to perform a measurement of a brightness value of the planar display region of the curved display panel in the display of each of gray scales if the color cast value of a second color coordinate of the plurality of second color coordinates relative to the first color coordinate is not within the given color cast specification range.

In an embodiment of the present disclosure, the program instructions, when executed by the processor 601, cause the processor 601 to calculate a color cast value Δu'v' of each of the plurality of second color coordinates relative to the first color coordinate according to the following formula:

$$\Delta u'v'=[(u'-u_0')^2+(v'-v_0')^2]^{1/2}$$

Where $u_0'$ represents a x coordinate value of the first color coordinate; $v_0'$ represents a y coordinate value of the first color coordinate; u' represents a x coordinate value of each of the plurality of second color coordinates; and v' represents a y coordinate value of each of the plurality of second color coordinates.

An embodiment of the present disclosure provides a non-transitory computer-readable storage medium. The non-transitory computer-readable storage medium stores computer programs which, after being loaded into a processor, cause the processor to perform the following steps. A first gamma voltage is determined in a situation that a planar display region of the curved display panel is horizontally placed and in a white balance state. A curved display region of the curved display panel is divided into a plurality of sub-regions according to a bending degree of the curved display region of the curved display panel, and a plurality of inclined angles in a one-to-one correspondence with the bending degrees of the plurality of sub-regions are determined. In addition, a plurality of second gamma voltages in a one-to-one correspondence with the plurality of inclined angles are determined in a situation that the planar display region of the curved display panel is tilted at the plurality of inclined angles relative to a position where the planar display region is horizontally placed and the planar display region is in the white balance state. Furthermore, the first gamma voltage is used as a gamma voltage of the planar display region of the curved display panel, and each of the second gamma voltages is used as a gamma voltage of a corresponding sub-region of the plurality of sub-regions.

An embodiment of the present disclosure provides a computer program product. The computer program product includes program stored in a computer-readable medium, and the program, when executed by a processor, performs the following steps. A first gamma voltage is determined in a situation that a planar display region of the curved display panel is horizontally placed and in the white balance state. A curved display region of the curved display panel is divided into a plurality of sub-regions according to a bending degree of the curved display region of the curved display panel, and a plurality of inclined angles in a one-to-one correspondence with the bending degrees of the plurality of sub-regions is determined. In addition, a plurality of second gamma voltages in a one-to-one correspondence with the plurality of inclined angles are determined in a situation that the planar display region of the curved display panel is tilted at the plurality of inclined angles relative to a position where the planar display region is horizontally placed and the planar display region is in the white balance state. Furthermore, the first gamma voltage is used as a gamma voltage of the planar display region of the curved display panel, and each of the plurality of second gamma voltages is used as a gamma voltage of a corresponding sub-region of the plurality of sub-regions.

The steps of the method or algorithm described in the embodiments of the present disclosure may be implemented by executing software instructions by a processor. The software instructions may be stored in a random access memory (RAM), a flash memory, a read only memory (ROM), a erasable programmable read only memory (EPROM), an electrically erasable programmable read only memory (EEPROM), a register, a hard disk, a removable disk, a compact disk read only memory (CD-ROM), or any other form of storage medium known by a person skilled in the art. In an embodiment of the present disclosure, the storage medium is coupled to the processor such that the processor can read information from the storage medium and can write information into the storage medium. The processor may be a device having logic operation capability and/or a program execution capability, such as a Central Processing Unit (CPU), a Field Programmable Gate Array (FPGA), a Microcontroller Unit (MCU), or an Application Specific Integrated Circuit (ASIC).

It should be appreciated by those skilled in the art that in the one or more examples described above, the functions described herein may be implemented with hardware, software, firmware, or any combination thereof. When implemented with software, the functions may be stored in a computer-readable medium or output as one or more instructions or codes on a computer-readable medium. The computer readable medium includes both a computer storage medium and a communication medium including any medium that facilitates transfer of a computer program from one place to another. The storage medium may be any available medium that can be accessed by a general purpose computer or a special purpose computer. In an embodiment of the present disclosure, communication may be performed directly or indirectly through a network connection when communication of data, information or the like occurs. For example, the network may include a wireless network, a wired network, and/or any combination thereof. The network may include local area network, internet, telecommunications network, internet of things based on internet and/or telecommunications networks, and/or any combination of the above networks, and the like. The wired network for example may use a transmission method such as twisted pair, coaxial cable or optical fiber for communication. The wireless network for example may use a 3G/4G/5G mobile communication network, a Bluetooth, a Zigbee or a WiFi communication method.

It should be noted that, relational terms such as "first" and "second" herein are merely used to distinguish one entity or operation from another entity or operation, rather than requiring or implying any such actual relationship or order between these entities or operations.

In addition, those skilled in the art should understand that the embodiments of the present disclosure may be provided as a method, a system, or a computer program product. Accordingly, the present disclosure may take the form of an entirely hardware embodiment, an entirely software embodiment, or an embodiment combining software and hardware. Moreover, the present application may take the form of a computer program product implemented on one or more computer available storage medium (including, but not limited to, magnetic disk storage and optical storage) containing computer available program codes.

This embodiments of the present disclosure is described with reference to the flowchart and/or the block diagram of a method, an apparatus (system), and a computer program product according to the embodiments of the present disclosure. It should be understood that each flow and/or block in the flowcharts and/or block diagrams, and combinations of the flows and/or blocks in the flowcharts and/or the block diagrams, may be implemented by computer program instructions. These computer program instructions may be provided to a processor of a general purpose computer, a special purpose computer, an embedded processor, or other programmable data processing apparatus to produce a machine such that the instructions, which execute via the processor of the computer or other programmable data processing apparatus, produce the means for implementing the functions specified in one or more flows in the flowchart and/or one or more blocks in the block diagrams.

These computer program instructions may also be stored in a computer readable memory, thereby directing a computer or other programmable data processing apparatus to work in a particular manner such that the instructions stored in the computer readable memory produce an article of manufacture including instruction means. The instruction means implements the functions specified in one or more flows in the flowchart and/or one or more blocks in the block diagrams.

These computer program instructions may also be loaded into a computer or other programmable data processing apparatus to cause the computer or other programmable apparatus to perform a series of operating steps so as to produce computer-implemented processes, therefore the instructions executed by the computer or other programmable apparatus provide steps for implementing the functions specified in one or more flows in the flowchart and/or one or more blocks in the block diagrams.

Although the exemplary embodiments of the present disclosure have been described, those skilled in the art may make other variations and modifications to these embodiments once they have acquired the basic inventive concept. Therefore, the appended claims are intended to be interpreted as including schematic embodiments and all changes and modifications falling within the scope of the present disclosure.

Obviously, those skilled in the art can make various modifications and variations to the present disclosure without departing from the spirit and scope of the present disclosure. In this way, if these modifications and variations of the disclosure fall within the scope of the claims of the disclosure and the equivalent technologies, the disclosure is also intended to include these modifications and variations.

The present disclosure may further provide additional embodiments that may include any one of the above embodiments, and one or more of the components, functions, or structures in the additional embodiments may be replaced or supplied by that of the above embodiments.

What is claimed is:

1. A method for adjusting a gamma voltage of a curved display panel, comprising:

determining a first gamma voltage in a situation that a planar display region of the curved display panel is horizontally placed and in a white balance state;

dividing a curved display region of the curved display panel into a plurality of sub-regions according to a bending degree of the curved display region of the curved display panel, and determining a plurality of inclined angles in a one-to-one correspondence with bending degrees of the plurality of sub-regions;

determining a plurality of second gamma voltages in a one-to-one correspondence with the plurality of inclined angles in a situation that the planar display region of the curved display panel is tilted at the plurality of inclined angles relative to a position where the planar display region is horizontally placed and the planar display region is in the white balance state; and using the first gamma voltage as a gamma voltage of the planar display region of the curved display panel, and using each of the plurality of second gamma voltages as a gamma voltage of a corresponding sub-region of the plurality of sub-regions.

2. The method for adjusting gamma voltages according to claim 1, wherein, dividing the curved display region of the curved display panel into the plurality of sub-regions according to the bending degree of the plurality of curved display region of the curved display panel comprises:

according to the bending degree of the curved display region of the curved display panel, dividing the curved display region of the curved display panel into a plurality of sub-regions which decrease in area in turn as bending degrees of the plurality of the sub-regions increase in turn; and/or, according to the bending degree of the curved display region of the curved display panel, dividing the curved display region of the curved display panel into a plurality of sub-regions which increase in number as the bending degree of the curved display region increases.

3. The method for adjusting gamma voltages according to claim 1, wherein, determining the plurality of inclined angles in a one-to-one correspondence with the bending degrees of the plurality of sub-regions comprises:

determining an included angle between a tangent plane of each of the plurality of sub-regions and the planar display region as a corresponding inclined angle of the plurality of inclined angles, the included angle being an acute angle.

4. The method for adjusting gamma voltages according to claim 1, wherein, determining the first gamma voltage or determining the plurality of second gamma voltages in a one-to-one correspondence with the plurality of inclined angles comprises:

measuring a brightness value of the planar display region of the curved display panel in a display of each of gray scales, and generating a corresponding gamma curve; and using a gamma voltage, which corresponds to the gamma curve when the gamma curve overlaps with a gamma standard curve, as the first gamma voltage; or using a plurality of gamma voltages, each of which corresponds to the gamma curve when the gamma curve overlaps with the gamma standard curve, as the plurality of second gamma voltages in a one-to-one way.

5. The method for adjusting gamma voltages according to claim 4, wherein, in the situation that the planar display region of the curved display panel is tilted at the plurality of inclined angles relative to the position where the planar display region is horizontally placed, before measuring the brightness value of the planar display region of the curved display panel in the display of each of gray scales, the method further comprises:

determining a first color coordinate of the planar display region of the curved display panel in the situation that the planar display region of the curved display panel is horizontally placed and in the white balance state;

determining a plurality of second color coordinates of the planar display region of the curved display panel in a one-to-one correspondence with the plurality of inclined angles in the situation that the planar display region of the curved display panel is tilted at the plurality of inclined angles relative to the position where the planar display region is horizontally placed and the planar display region is in the white balance state;

determining whether a color cast value of each of the plurality of second color coordinates relative to the first color coordinate is within a given color cast specification range;

if the color cast value of a second color coordinate of the plurality of second color coordinates relative to the first color coordinate is within the given color cast specification range, using the first gamma voltage as a corresponding second gamma voltage of the plurality of gamma voltages; and if the color cast value of a second color coordinate of the plurality of second color coordinates relative to the first color coordinate is not within the given color cast specification range, performing a measurement of a brightness value of the planar display region of the curved display panel in the display of each of gray scales.

6. The method for adjusting gamma voltages according to claim 5, wherein, determining the color cast value of each of the plurality of second color coordinates relative to the first color coordinate comprises:

calculating a color cast value Δu'v' of each of the plurality of second color coordinates relative to the first color coordinate according to a formula:

$$\Delta u'v' = [(u' - u_0')^2 + (v' - v_0')^2]^{1/2}$$

where u0' represents a x coordinate value of the first color coordinate, v0' represents a y coordinate value of the first color coordinate, u' represents a x coordinate value of each of the plurality of second color coordinates, and v' represents a y coordinate value of each of the plurality of second color coordinates.

7. A computer non-transitory readable storage medium, storing computer programs which, after being loaded into a processor, cause the processor to perform the method for adjusting the gamma voltage of the curved display panel as claim 1.

8. A device for adjusting a gamma voltage of a curved display panel, comprising:

a memory storing program instructions; and a processor, wherein the program instructions, when executed by the processor, cause the processor to:

determine a first gamma voltage in a situation that a planar display region of the curved display panel is horizontally placed and in a white balance state;

divide a curved display region of the curved display panel into a plurality of sub-regions according to a bending degree of the curved display region of the curved display panel, and determine a plurality of inclined angles in a one-to-one correspondence with bending degrees of the plurality of sub-regions;

determine a plurality of second gamma voltages in a one-to-one correspondence with the plurality of inclined angles in a situation that the planar display region is tilted at the plurality of inclined angles relative to a position where the planar display region is horizontally placed and the planar display region is in the white balance state; and use the first gamma voltage as a gamma voltage of the planar display region, and use each of the plurality of second gamma voltages as a gamma voltage of a corresponding sub-region of the plurality of sub-regions.

9. The device for adjusting gamma voltages according to claim 8, wherein, the program instructions, when executed by the processor, cause the processor to, according to the bending degree of the curved display region of the curved display panel, divide the curved display region of the curved display panel into a plurality of sub-regions which decrease in area in turn as bending degrees of the plurality of sub-regions increase in turn; and/or, to, according to the bending degree of the curved display region of the curved display panel, divide the curved display region of the curved display panel into a plurality of sub-regions which increase in number as the bending degree of the curved display region increases.

10. The device for adjusting gamma voltages according to claim 8, wherein, the program instructions, when executed by the processor, cause the processor to determine an included angle between a tangent plane of each of the plurality of sub-regions and the planar display region as a corresponding inclined angle of the plurality of inclined angles, the included angle being an acute angle.

11. The device for adjusting gamma voltages according to claim 8, wherein, the program instructions, when executed by the processor, cause the processor to:

measure a brightness value of the planar display region of the curved display panel in a display of each of gray scales, and generate a corresponding gamma curve; and use a gamma voltage, which corresponds to the gamma curve when the gamma curve overlaps with a gamma standard curve, as the first gamma voltage; or use a plurality of gamma voltages, each of which corresponds to the gamma curve when the gamma curve overlaps with the gamma standard curve, as the plurality of second gamma voltages in a one-to-one way.

12. The device for adjusting gamma voltages according to claim 11, wherein, the program instructions, when executed by the processor, cause the processor to:

determine a first color coordinate of the planar display region of the curved display panel in the situation that the planar display region of the curved display panel is horizontally placed and in the white balance state;

determine a plurality of second color coordinates of the planar display region of the curved display panel in a one-to-one correspondence with the plurality of inclined angles in the situation that the planar display region of the curved display panel is tilted at the plurality of inclined angles relative to the position where the planar display region is horizontally placed and the planar display region is in the white balance state;

determine whether a color cast value of each of the plurality of second color coordinates relative to the first color coordinate is within a given color cast specification range;

if the color cast value of a second color coordinate of the plurality of second color coordinates relative to the first color coordinate is within the given color cast specification range, use the first gamma voltage as a corresponding second gamma voltage of the plurality of gamma voltages; and if the color cast value of a second color coordinate of the plurality of second color coordinates relative to the first color coordinate is not within the given color cast specification range, perform a measurement of a brightness value of the planar display region of the curved display panel in the display of each of gray scales.

13. The device for adjusting gamma voltages according to claim 12, wherein, the program instructions, when executed by the processor, cause the processor to:

calculate a color cast value Δu'v' of each of the plurality of second color coordinates relative to the first color coordinate according to a formula:

$$\Delta u'v' = [(u' - u_0')^2 + (v' - v_0')^2]^{1/2}$$

where u0' represents a x coordinate value of the first color coordinate, v0' represents a y coordinate value of the first color coordinate, u' represents a x coordinate value of each of the plurality of second color coordinates, and v' represents a y coordinate value of each of the plurality of second color coordinates.

* * * * *